US005216699A

United States Patent [19]

Iketaki

[11] Patent Number: 5,216,699

[45] Date of Patent: Jun. 1, 1993

[54] X-RAY MICROSCOPE

[75] Inventor: Yoshinori Iketaki, Oume, Japan

[73] Assignee: Olympus Optical Co., Ltd., Tokyo, Japan

[21] Appl. No.: 945,700

[22] Filed: Sep. 16, 1992

[30] Foreign Application Priority Data

Sep. 17, 1991 [JP] Japan ..... 3-236288
Feb. 10, 1992 [JP] Japan ..... 4-023753
May 29, 1992 [JP] Japan ..... 4-138669

[51] Int. Cl.[5] ..... G21K 7/00

[52] U.S. Cl. ..... 378/43; 378/161; 378/208

[58] Field of Search ..... 378/43, 161, 208, 79-81

[56] References Cited

U.S. PATENT DOCUMENTS 4,602,377 7/1986 Schiferl ..... 378/80

OTHER PUBLICATIONS

J. H. Klems, "X-ray Absorption in Valence-excited Molecules as a Possible Contrast Mechanism for Chemically Sensitive Imaging and Spectroscopy", Physical Review A, vol. 43, No. 4, Feb. 1991, pp. 2041-2045.

*Primary Examiner*—Craig E. Church
*Attorney, Agent, or Firm*—Cushman, Darby & Cushman

[57] ABSTRACT

An X-ray microscope has an X-ray filter for transmitting a wavelength between 43.7 and 65 Å and a light source for emitting ultraviolet light of a wavelength of at least 100 nm in an optical path so that a specimen is irradiated with X rays and an image of an object is formed by an X-ray detector, in which the ultraviolet light is reflected from the X-ray filter to irradiate the specimen. Thus, the X-ray microscope allows biological observation to be made with a transmitted microscopic image of high quality and has advantages in design and choice of materials in fabricating its system.

11 Claims, 9 Drawing Sheets

X RAY
27
42
43
TV CAMERA
41
Vd
A/D
44
A/D
45
FRAME MEMORY
46
FRAME MEMORY
47
Fa
Fb
DIFFERENTIAL CIRCUIT (Fa-Fb)
48
DATA SELECTOR
50
Ta
Tb
Qs
21
HOST COMPUTER
49
52
Pr
POLARIZER DRIVING CIRCUIT
51
Sr
33

X-RAY MICROSCOPE

BACKGROUND OF THE INVENTION a) Field of the Invention

This invention relates to an X-ray microscope and, more particularly, to an X-ray image forming apparatus.

b) Description of the Prior Art

Recently, researches and developments of X-ray radiation sources and X-ray optical elements have been advanced and, as one of their application systems, an X-ray microscope is proposed. As shown in FIGS. 1 to 3, various types of optical elements used in the X-ray microscope are available. FIG. 1 shows a Wolter reflecting optical system (in the figure, its reflecting surfaces are indicated only by solid lines). This is such that X rays are made incident on the reflecting surfaces at a large angle and reflected by utilizing total reflection at the reflecting surfaces, which is typical of a grazing incidence optical system. FIG. 2 shows a Fresnel zone plate utilizing diffraction. FIG. 3 shows a normal incidence type Schwarzschild optical system in which two spherical mirrors are each coated with a multilayer film. In this optical system, the multilayer film forms an artificial grating to reflect X rays by utilizing diffraction due to the grating.

Making use of the property that soft X rays cause little damage to a biological specimen, attention is also aroused as to the application to a biological microscope capable of observing the biological specimen with high resolution and with no staining. In the wavelength band of X rays having a wavelength $\lambda=43.7\sim23.6$ Å in particular, the absorptance of X rays in terms of carbon is high and the transmittance of X rays in terms of the molecule of water is also high, so that if it is applied to the biological microscope, the transmitted microscopic image of protein whose principal constituent atom is carbon can be observed with good contrast in water. Hence, research institutions are prosecuting researches and developments on the optical elements of X-ray multilayer film mirrors and filters, radiation sources, detectors, etc. which can be used with high accuracy in the above wavelength band.

In the wavelength band of $\lambda=43.7\sim23.6$ Å mentioned above, however, there is the problem of making difficult the fabrication of the optical element in which accuracy sufficient to be used as the X-ray microscope is realized and secured. Where the multilayer film reflecting mirror with high reflectance is generally designed, it is required that two kinds of substances with the largest possible difference between their refractive indices are built up alternately to form a multilayer film. With such a wavelength band, however, the refractive indices of most substances are close to unity and it is therefore difficult to choose two kinds of substances with the large difference between the refractive indices. Although a proposal is made for materials whose reflectances are expected to be somewhat improved, such as multilayer films of a structure (Ni/Sc) of laminating alternately Ni (nickel) and Sc (scandium) and another structure (Ni/Ti) of laminating alternately Ni and Ti (titanium), these materials are liable to crystallization in their evaporation, which fact makes it difficult to secure a uniform film. Additionally, in the current state-of-the-art of the film fabrication, the normal incidence mirror for the wavelength band of $\lambda=44\sim22$ Å is such that a basic period of the multilayer film (the total thickness of two substances laminated in a pair) is inevitably reduced to 20 Å or less, so that the fabrication of the multilayer film itself is difficult. Still further, in the wavelength band of $\lambda=43.7\sim23.6$ Å, other problems are encountered that the high absorptance of X rays in terms of carbon makes it impossible to use organic materials as filters and narrows the range of choice of filter materials. Thus, the optical element such that practical accuracy is secured is hard of design and requires careful discussion for the choice of materials.

Even though the optical system utilizing such an optical element has been realized which can image X rays in the wavelength band of $\lambda=43.7\sim23.6$ Å, there is the problem of making difficult the realization of a practical observing function of the X-ray microscope for observing the biological specimen with favorable contrast. The X-ray absorptance of the biological specimen depends on the density of carbon present in the specimen, the thickness of the biological specimen, and the wavelength of X rays with which the specimen is irradiated. Hence, in the case of microscopy of the biological specimen which, for example, is relatively high in carbon density and large in thickness, most of the X rays with which the specimen is irradiated are absorbed by the specimen and the resultant transmitted microscopic image is dark as a whole, poor in contrast, and hard of view, that is, diminishes the amount of information. Conversely, where the carbon density is low and the thickness is small, the transmittance of X rays is improved and the transmitted microscopic image becomes bright as a whole, but even in this case, the contrast is poor. That is, unless the above conditions of the biological specimen for determining the X-ray absorptance are all proper, the transmitted microscopic image of favorable contrast cannot be brought about.

In order to solve the foregoing problems, there is the method of adjusting the thickness of the biological specimen or the wavelength of X rays with which the specimen is irradiated in the wavelength band of $\lambda$ mentioned above. The former, however, uses a precision machine, such as a microtome, requiring operator skill to cut the specimen, which is disposed in the microscope optical system and irradiated with X rays, and if the resultant transmitted microscopic image lacks in contrast, the specimen will be cut again by the precision machine. Such operation is repeated through the rule of trial and error, thereby determining a proper thickness of the specimen. This has no practical use. The latter involves a wide change of design and the change of layout of the microscope optical system and the optical element in using the optical element of wave dispersion as in the zone plate or the Schwarzschild optical system, so that this method is also of little practical use and at variance with the reality.

SUMMARY OF THE INVENTION

It is, therefore, an object of the present invention to provide an X-ray microscope which allows a biological specimen to be observed with a transmitted microscopic image of high quality and offers advantages to the choices of design and materials in its fabrication.

This object is accomplished, according to the present invention, by the arrangement that, in the X-ray microscope in which a specimen is irradiated with X rays and an image of an object is formed by an X-ray detector, an X-ray filter transmitting the radiation of wavelengths from 43.7 to 65 Å and a light source emitting ultraviolet light of a wavelength of at least 100 nm are disposed in an optical path so that the ultraviolet light is reflected from the X-ray filter to irradiate the specimen.

According to another aspect, the present invention provides an X-ray image forming apparatus comprising a laser beam source for emitting plasma and X rays from the plasma, an X-ray condenser lens, an objective lens for converging the X rays, an X-ray detector for detecting the X rays, an X-ray filter transmitting the radiation of wavelengths from 43.7 to 65 Å and reflecting the radiation of a wavelength of at least 100 nm, a half mirror for splitting a beam from the laser beam source, and a frequency converting optical element for emitting ultraviolet light of a wavelength of at least 100 nm, in which the ultraviolet light is reflected from the X-ray filter to irradiate a specimen.

Thus, the transmitted microscopic image, excellent in contrast, with high quality can be secured and the microscopy and analysis of particular protein can be made with great ease.

This and other objects as well as the features and the advantages of the present invention will become apparent from the following detailed description of the preferred embodiments when taken in conjunction with the accompanying drawings.

DETAILED DESCRIPTION OF THE PREFERRED EMBODIMENTS

Figure 1:
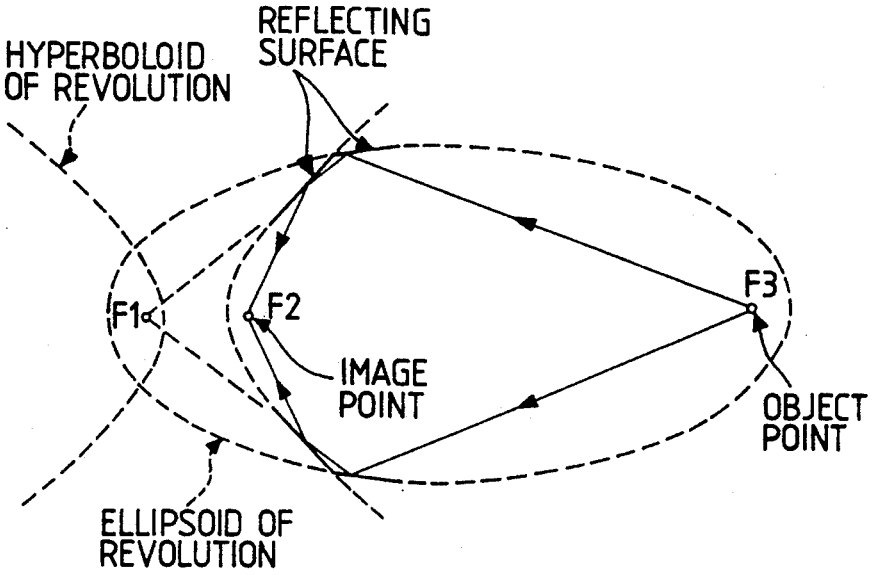
FIG. 1 PRIOR ART
FIGS. 1 to 3 are views showing fundamental configurations of a Wolter reflecting optical system, a Fresnel zone plate, and a normal incidence type Schwarzschild optical system, respectively.
Figure 2:
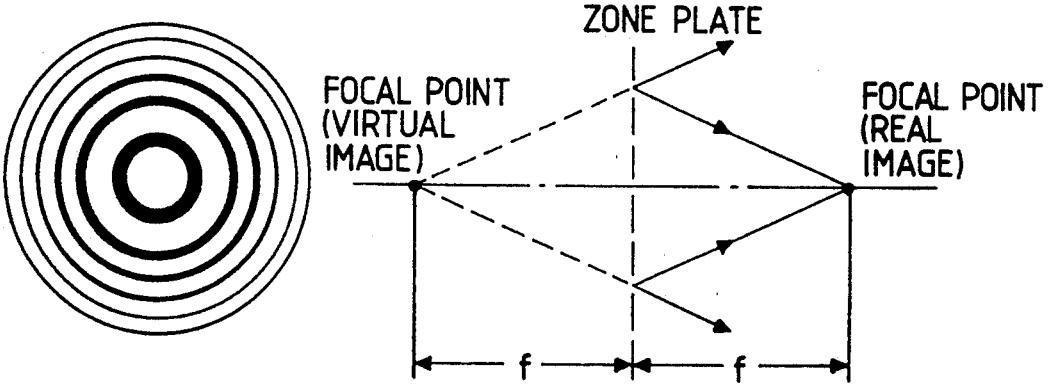
FIG. 2 PRIOR ART
Figure 3:
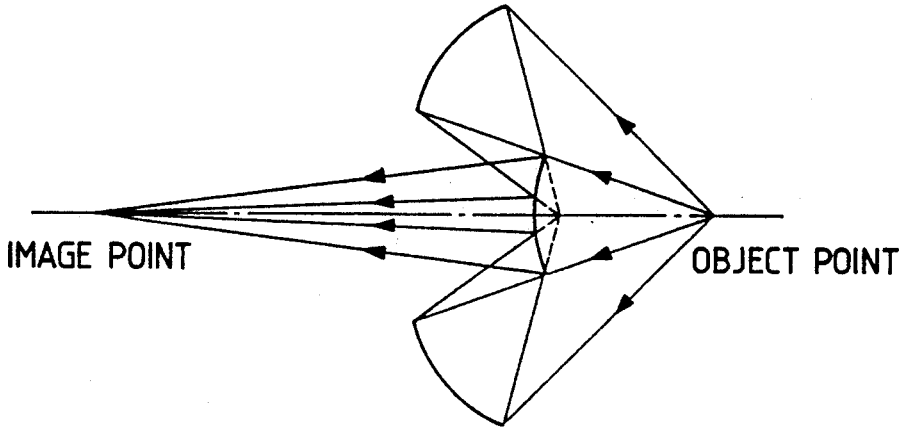
FIG. 3 PRIOR ART
Figure 4A:
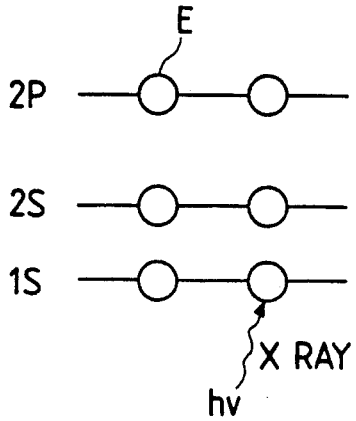
FIGS. 4A to 4F are schematic diagrams showing the transition states of electrons where a carbon atom absorbs X rays.
Figure 4B:
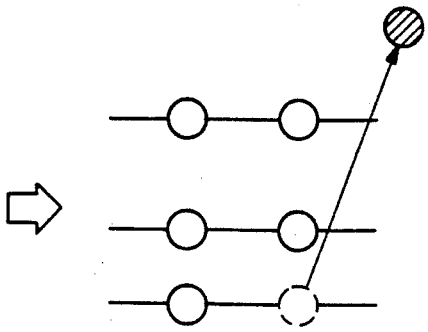
Figure 4C:
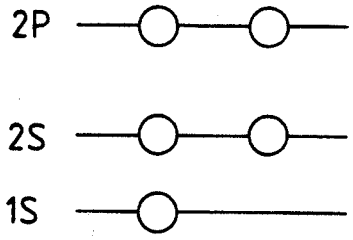
Figure 4D:
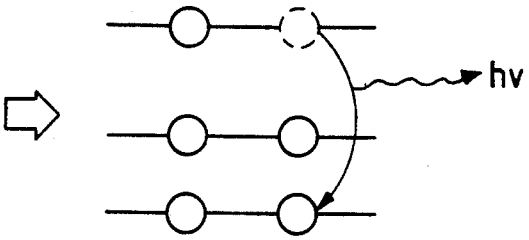
Figure 4E:
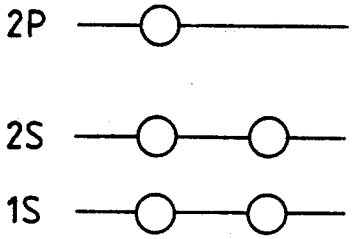
Figure 4F:
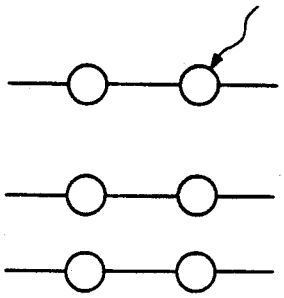
Figure 5A:
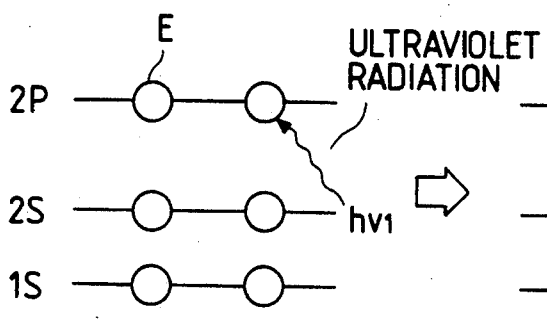
FIGS. 5A to 5D are schematic diagrams showing the transition states of electrons of the carbon atom, based on the principle shown in the present invention.
Figure 5B:
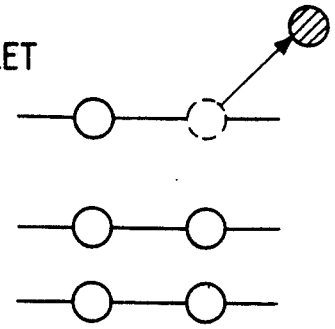
Figure 5C:
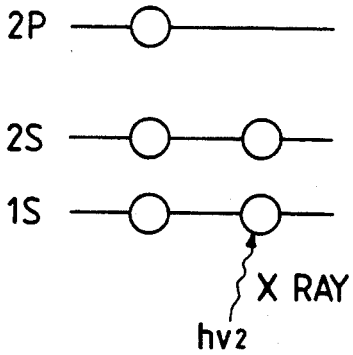
Figure 5D:
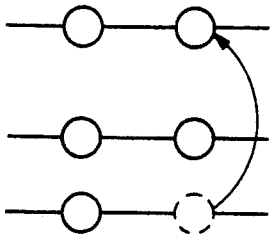

Currently, the method is proposed of securing selectively a microscopic image with high contrast, of the molecule of particular protein in a wavelength band excluding $\lambda=43.7\sim23.6$ Å. Referring now to FIGS. 4 to 8, prior to explaining the embodiments of the present invention, the principle of this method and the arrangement and function of the X-ray microscope according to the present invention will be described below.

FIGS. 4 and 5 show the configuration and transition states of electrons where a carbon atom absorbs X rays. FIG. 4A shows the electron configuration of the carbon atom in the ground state, in which there are 2 electrons each (represented by reference symbol E in the figure) in the 1s, 2s, and 2p orbits. Assuming now that X rays are radiated thereto, the electron in the 1s orbit is excited by the X rays to ionize and the carbon atom leaves a hole in the 1s orbit (see FIG. 4B; which is hereinafter referred to as "a first transition"). Since this state is very unstable in view of energy (see FIG. 4C), however, the electron in the 2p orbit transfers to the 1s orbit to secure its stability (see FIG. 4D; which is hereinafter referred to as "a second transition"). Further, a hole has been produced in the 2p orbit (see FIG. 4E), so that if carbon is a constituent element of the molecule of, for example, protein, the carbon atom will capture an electron from a surrounding constituent element to resume an initial ground state (see FIG. 4F; which is hereinafter termed "a third transition"). In general, the observation for which the X-ray microscope is used, of the transmitted microscopic image of protein, is made by utilizing energy absorption due to the first transition in the irradiation of X rays. In this case, unless the wavelengths of X rays are shorter than the absorption edge of carbon, the X rays will not be absorbed by protein, with the result that the contrast of the transmitted microscopic image is deteriorated.

Considering the preceding electron transitions from their inverse processes, however, it is noted that even though the wavelengths of X rays to be incident are longer than the absorption edge of carbon, the transmitted microscopic image can be observed with good contrast. Specifically, in the electron configuration of the carbon atom in the ground state shown in FIG. 5A, an electron of the 2p orbit in the ground state is first ionized so that a hole is produced in the 2p orbit (see FIG. 5B; which is the inverse process of the third transition). Then, in this state (see FIG. 5C), an electron in the 1s orbit is excited by X rays to the 2p orbit (see FIG. 5D; which is the inverse process of the second transition). This transition can be realized by photon energy lower than the absorption edge of carbon, that is, X rays of wavelengths longer than the absorption edge of carbon. The transition state (see FIG. 5D) is exactly the same as the state where the electron of the 1s orbit is directly ionized from the ground state in the first transition.

Figure 6:
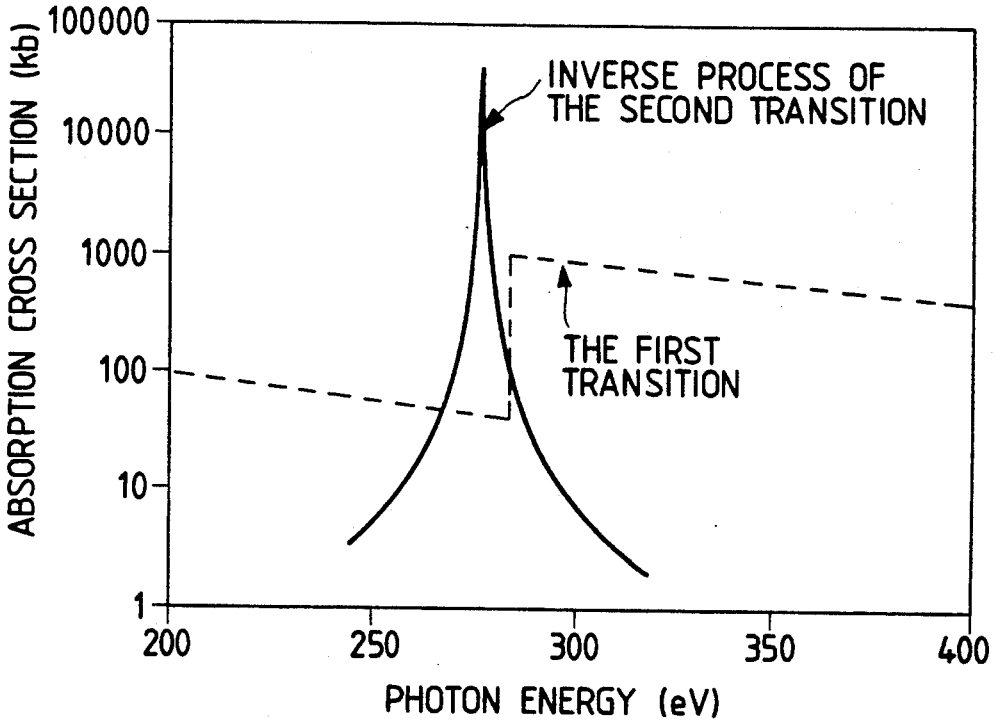
FIG. 6 is a graph showing the comparison between the methods according to the present invention and the prior art, with respect to energy required for the transition of an electron in the 2p orbit of the carbon atom.

In this technique, the energy required for ionizing the electron of the 2p orbit is approximately 5 eV (200 nm), and as a measure of ionization, for instance, an ultraviolet laser beam can be utilized. Further, the energy required for exciting the electron of the 1s orbit into the 2p orbit is nearly $10\sim20$ eV lower than the case of the excitation by the first transition. FIG. 6 shows this situation, from which it is seen that the inverse process of the second transition requires somewhat low energy compared with ordinary ionization of the electron due to absorption, namely, the first transition. In the case of the carbon atom of protein, the absorption wavelength by the inverse process of the second transition is within the range of nearly $43\sim65$ Å. Thus, by a two-stage process that the electron of the 2p orbit of the carbon atom in the ground state is ionized and subsequently the electron of the 1s orbit is excited into the 2p orbit, the transmitted image of protein can be obtained even in the wavelengths longer than the absorption edge of carbon.

The technique mentioned above was theoretically verified by J. H. Klems, regarding the following quantitative superiority (J. H. Klems, Phys. Rev., Vol. 43, 1991, pp. 2041~2045):

(1) The use of X rays of wavelengths longer than the carbon absorption edge makes it possible to choose satisfactory materials, such as W (tungsten)/C (carbon), which are excellent in optical constant and easy of film fabrication, in fabricating the multilayer film mirror.

(2) Since the energy required for ionizing the electron of the 2p orbit depends on the kind of protein, the carbon atom of particular protein can be selectively ionized by adjusting the wavelength of incidence of the ultraviolet laser beam, for instance. Further, the energy required for a successive electron transition from the 1s orbit to the 2p orbit is also determined uniquely. Hence, when X rays having the equivalent photon energy are taken as a probe, the transmitted microscopic image of particular protein can be observed. Additionally, the contrast of the transmitted microscopic image is enhanced more than one figure compared with the conventional method utilizing the wavelength band of $\lambda=43.7\sim23.6$ Å (see FIG. 6).

Figure 7:
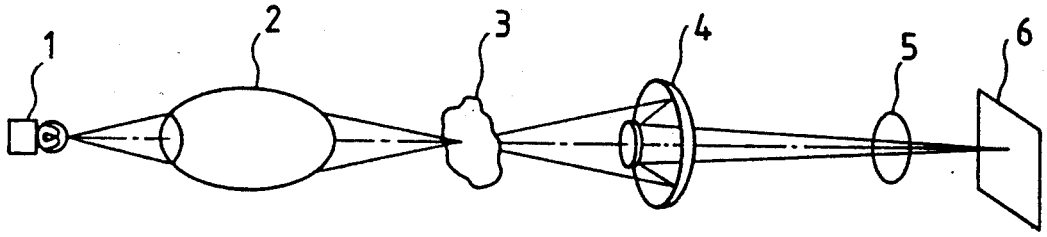
FIG. 7 is a view showing the arrangement of an ordinary X-ray microscope.

The application of the foregoing principle to an X-ray microscope brings about a high-performance X-ray microscope. An ordinary X-ray microscope of prior art, as depicted in FIG. 7, comprises an X-ray radiation source 1, an X-ray condenser lens 2 for collecting radiation, a biological specimen 3 to be observed, an X-ray objective lens 4, a filter 5, and a detector 6. The objective lens 4 falls into two categories: a wave dispersion type such as the zone plate or the Schwarzschild optical system and a grazing incidence mirror type of collecting white light as in the Wolter optical system, but where a source of white light is used for the source 1 to employ the Wolter objective lens, there is a necessity for the disposition of a spectrometer on an optical path in front of the detector 6. An image sensor, such as an MCP (microchannel plate), a CCD, etc., is utilized for the detector 6, and when the source of white light is used for the source 1, a thin film filter made of, for example, Be (beryllium), is disposed for the filter 5 in order to cut stray light of long wavelengths from the ultraviolet region.

Figure 8:
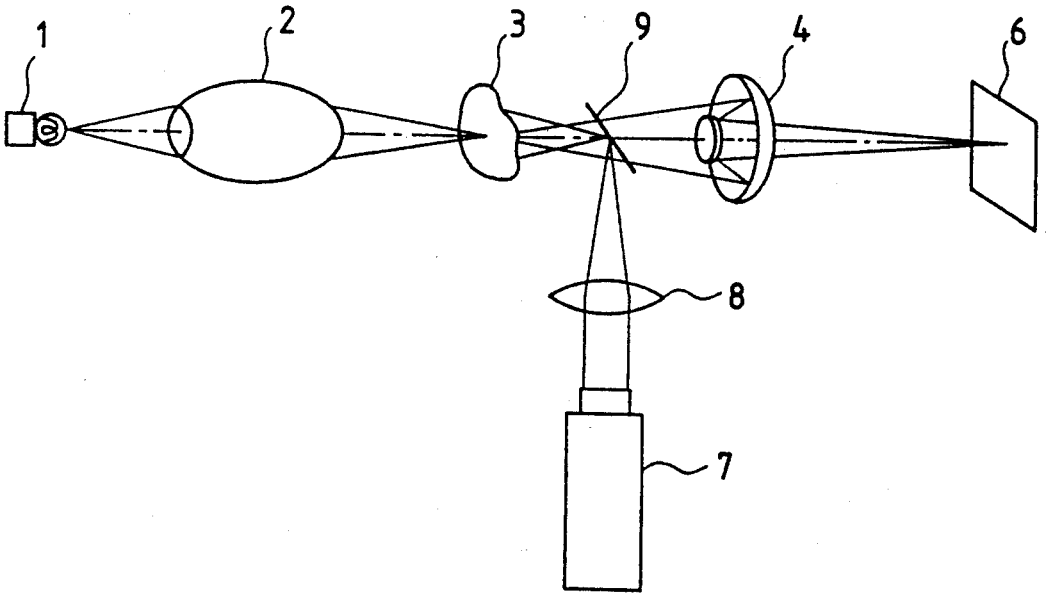
FIG. 8 is a view showing a fundamental arrangement of an X-ray microscope according to the present invention.

FIG. 8 shows a basic conceptional view of the X-ray microscope according to the present invention in which the technique proposed by J. H. Klems is applied to the preceding arrangement. In FIG. 8, reference numeral 7 represents an ultraviolet light source outputting ultraviolet laser beams, 8 a condenser lens, and 9 an X-ray filter. Although its fundamental arrangement is the same as in FIG. 7, the X-ray microscope of the present invention is provided with the X-ray filter 9 between the biological specimen 3 and the X-ray objective lens 5. The X-ray filter 9, composed of a thin film made of, for example, Be, uses a thin film material chosen from substances and is formed so as to possess properties of producing high transmittance for the incident radiation in the wavelength band of 65~43.7 Å and high reflectance for that in the ultraviolet region.

In such an arrangement, if, in imaging the biological specimen 3, it is irradiated at the same time with X-rays having photon energy accommodating the inverse process of the second transition from the radiation source 1 and the ultraviolet laser beam adjusted to photon energy accommodating the inverse process of the third transition from the ultraviolet light source 7, it is possible to ionize only the carbon atom of particular protein, and the resultant is the transmitted microscopic image of the biological specimen 3 secured through the detector 6. Furthermore, since the X-ray filter 9 reflects the stray light of long wavelengths from the ultraviolet region which results in an image noise at the detector 6, the transmitted microscopic image can be observed as the image of high quality in which noise components are cut.

In addition to this arrangement, if a measure is disposed for changing the intensity of the ultraviolet light with which the biological specimen is irradiated, thereby adjusting artificially the intensity of the ultraviolet light, it is possible to control easily the contrast of the transmitted microscopic image without any adjustment of the wavelengths of X rays for irradiation and the thickness of the biological specimen. Specifically, in the electron configuration after the irradiation of the ultraviolet light shown in FIG. 5D, the absorptance of X rays of the biological specimen is proportional to the number of carbon having holes in the 2p orbit, which is proportional to the intensity of the ultraviolet light with which the biological specimen has been irradiated. Making use of this property, the intensity of the ultraviolet light is adjusted, thereby enabling the absorptance of X rays of the biological specimen to be easily changed and the transmitted microscopic image having the optimum contrast to be secured.

Further, if photographs are taken of the transmitted microscopic images of the biological specimens where the specimen is irradiated with the ultraviolet light from the ultraviolet light source and where it is not irradiated to prepare a differential image in which the difference in brightness between the transmitted microscopic images is extracted, it is possible to remove the background attributable to absorption due to elements other than carbon, with the resultant transmitted X-ray image of excellent contrast, of pure carbon only.

Now, in reference to the drawings, the embodiments of the present invention will be described below.

First embodiment

Figure 9:
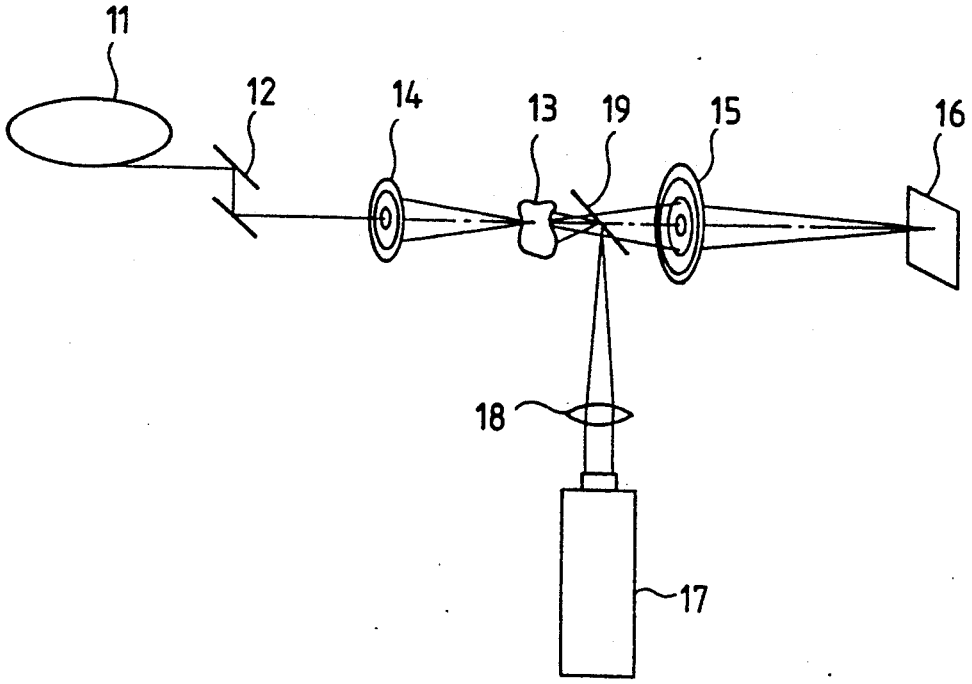
FIG. 9 is a view showing the arrangement of a first embodiment of the X-ray microscope according to the present invention.

FIG. 9 shows the first embodiment of the present invention, in which SOR (synchrotron radiation) is used as a radiation source and a Fresnel zone plate is utilized as an X-ray optical system. In the figure, reference numeral 11 denotes an SOR source; 12 a crystal spectrometer; 13 a specimen composed of, for example, protein; 14 a condenser zone plate; 15 an objective zone plate; 16 a detector consisting of an MCP; 17 an ultraviolet light source; 18 a condenser lens; and 19 an X-ray filter. The X-ray filter 19 is composed of a thin Be film of a thickness of approximately 300 Å and disposed, at an angle of 45° with the optical axis of the X-ray microscope, between the specimen 13 and the objective zone plate 15 so that an ultraviolet laser beam emitted from the ultraviolet light source 17 is reflected from the thin Be film to irradiate the back face of the specimen 13. The thin Be film, which has low transmittance for incident light of long wavelengths from the ultraviolet region, provides also blocking action for preventing the stray light causing an image noise from entering the detector 16.

The first embodiment is constructed as mentioned above, so that in imaging the specimen 13, if it is irradiated at the same time with the radiation of photon energy accommodating the inverse process of the second transition from the radiation source 11 and the ultraviolet laser beam adjusted to photon energy accommodating the inverse process of the third transition from the ultraviolet light source 17, only the carbon atom of particular protein can be ionized and the stray light of noise components is cut by the X-ray filter 19, with the result that the transmitted microscopic image of the specimen 13 can be observed as the image of high quality through the detector 16.

Second embodiment

Figure 10:
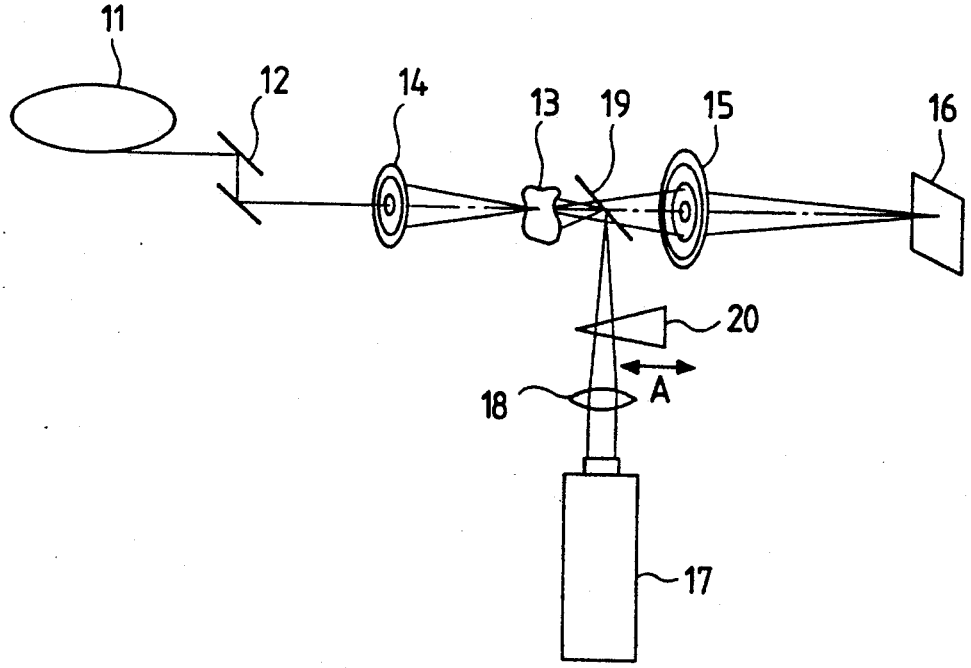
FIG. 10 is a view showing the arrangement of a second embodiment.

FIG. 10 shows the second embodiment of the present invention, which has the same arrangement as the first embodiment, except that a wedge filter 20 is disposed in the optical path of the ultraviolet light source 17. The wedge filter 20 is made of glass of high absorptance, for example, BK 7, in terms of ultraviolet light, and disposed in the optical path of the ultraviolet light source 17 to be movable perpendicular to the optical axis of the ultraviolet laser beam emitted from the light source 17 (the direction of movement is indicated by an arrow A in the figure).

The second embodiment is constructed as mentioned above, so that if the wedge filter 20 is shifted to a proper position, the ultraviolet laser beam emitted from the ultraviolet light source 17, when passing through the wedge filter 20, will be changed in terms of the optical path length, thereby allowing the amount of the ultraviolet laser beam for irradiating the biological specimen 13 to be properly adjusted and the absorptance of X rays of the biological specimen 13 to be changed. Thus, if, in imaging the biological specimen 13, it is irradiated at the same time with the radiation of photon energy accommodating the inverse process of the second transition from the radiation source 11 and the ultraviolet laser beam adjusted to photon energy accommodating the inverse process of third transition from the ultraviolet light source 17 and controlled in amount of light by the wedge filter 20, only the carbon atom of particular protein can be ionized, which is detected by the detector 16, and thereby the transmitted microscopic image of the biological specimen 13 can be derived with good contrast. Moreover, since the stray light of noise components is cut by the X-ray filter 19, the observation of the transmitted microscopic image of high quality, having little noise, can be realized.

Third embodiment

Figure 11:
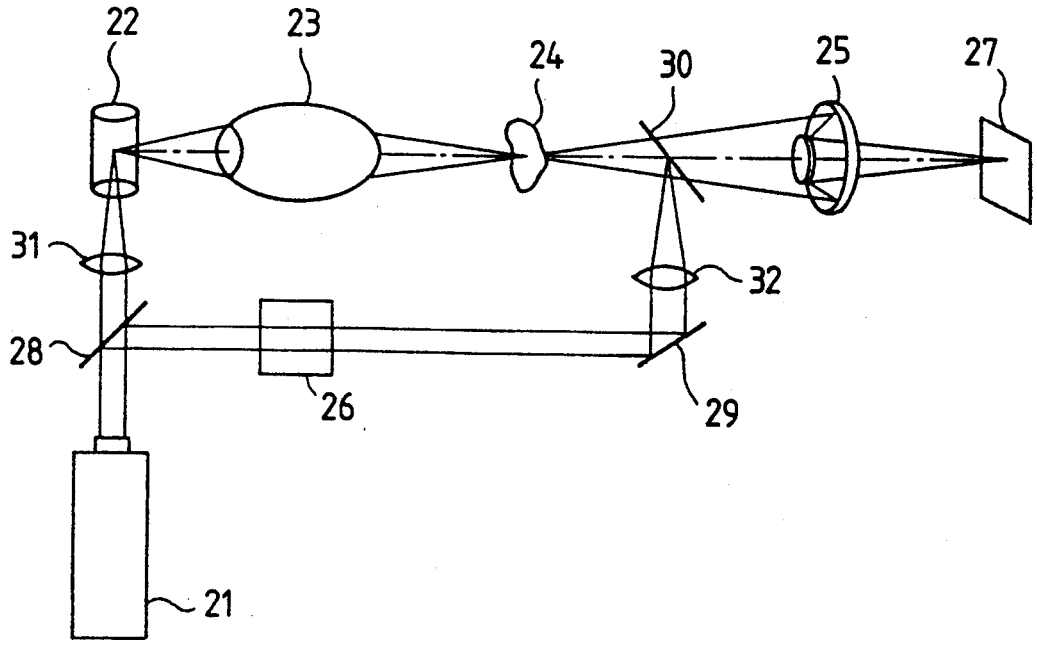
FIG. 11 is a view showing the arrangement of a third embodiment.

FIG. 11 shows the third embodiment of the present invention which uses a laser beam source for converging a YAG laser beam to a target to change the irradiated part of the target into a plasma and outputting X rays therefrom, as a radiation source, and utilizes the Wolter mirror as the X-ray condenser lens and the Schwarzschild optical system as the X-ray objective lens. In this figure, reference numeral 21 represents a laser beam source; 22 a laser target on which the YAG laser beam from the laser beam source 21 is incident, for outputting X rays; 23 an X-ray condenser lens for the Wolter mirror; 24 a biological specimen; 25 an X-ray objective lens for the Schwarzschild optical system; 26 a KDP crystal; 27 a detector utilizing the MCP; 28 a half mirror for splitting the YAG laser beam output from the laser beam source 21; 29 a mirror; 30 an x-ray filter; and 31 and 32 condenser lenses.

The function of the third embodiment, although fundamentally identical with that of the first embodiment, in such that a part of the laser beam output from the laser beam source 21 is split by the half mirror 28 in order to produce X rays at the target 22, higher harmonics four times those of the ultraviolet region are produced from the other of the split laser beam by the KDP crystal 26, and the biological specimen 24 is irradiated with the higher harmonics as photon energy accommodating the inverse process of the third transition through the X-ray filter 30, thus doing away with the need for the ultraviolet light source for outputting the ultraviolet laser beam. Also, for the multilayer film mirror used in the Schwarzschild optical system of the X-ray objective lens 25, the one composed of W/C is excellent, and in the case of the normal incidence of the laser beam having the wavelength of 45 Å, the reflectance of nearly 30% can be derived if the number of layers to be built up is 200.

Fourth embodiment

Figure 12:
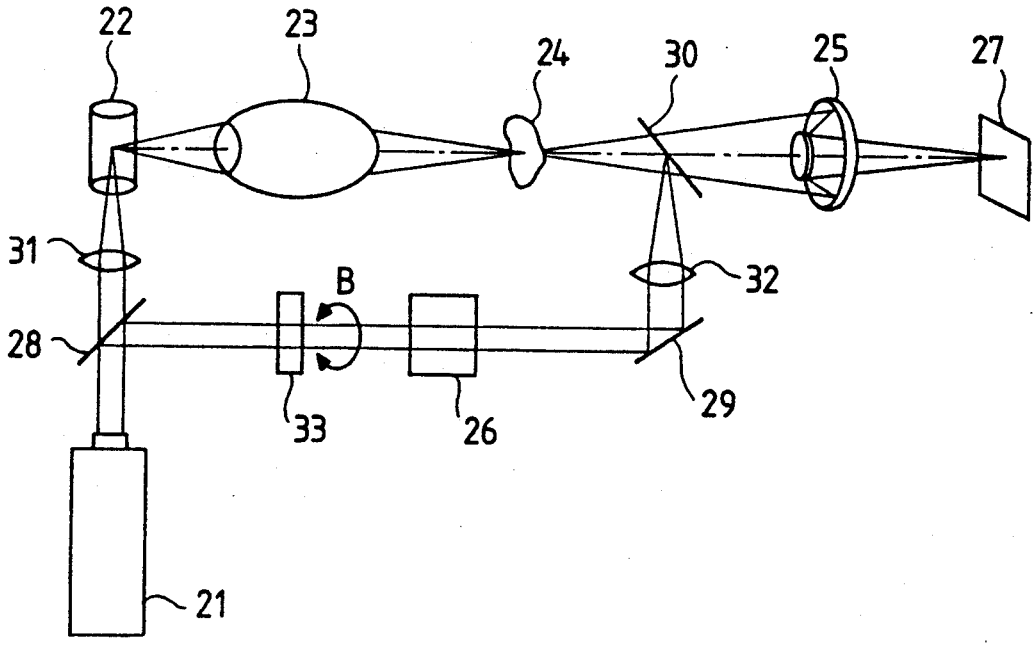
FIG. 12 is a view showing the arrangement of a fourth embodiment.

FIG. 12 shows the fourth embodiment of the present invention, which in addition to the arrangement of the third embodiment, provides a polarizer 33 rotated, in the direction indicated by an arrow B in the figure, through a polarizer driving circuit 51 which will be described later. By rotating the polarizer 33 about the optical axis of the laser beam incident on the KPD crystal 26, the amount of the ultraviolet light with which the biological specimen 24 is irradiated can be adjusted.

Figure 13:
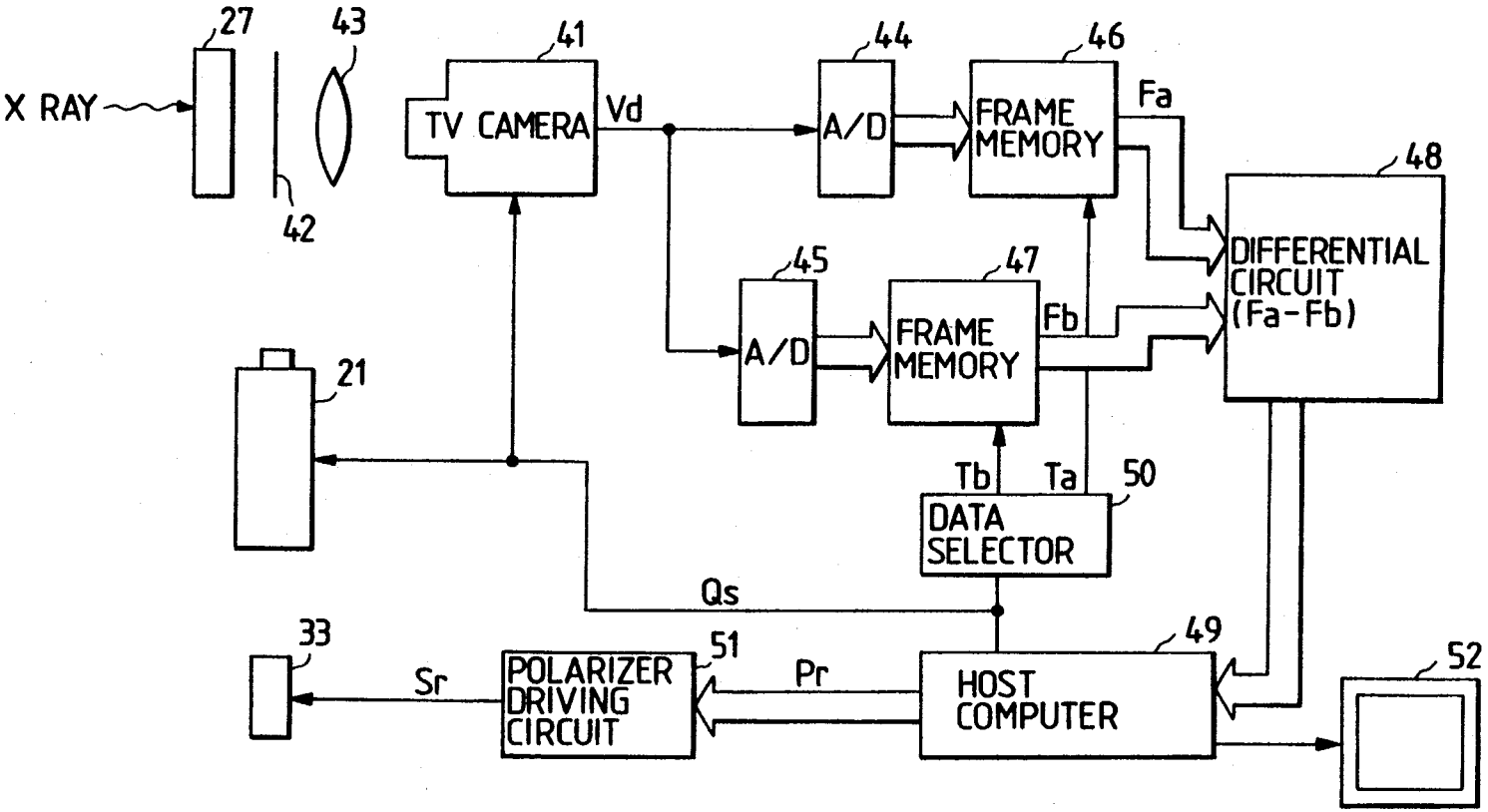
FIG. 13 is a circuit block diagram of an image signal processing system in the fourth embodiment.

FIG. 13 is a circuit block diagram of an image signal processing system in the fourth embodiment. In this figure, reference numeral 41 designates a TV camera for photographing, through a variable magnification lens 43, the transmitted microscopic image visualized through the detector 27 and a phosphor 42; 44 and 45 A/D converting boards for converting analog image signals Vd output from the TV camera 41 into digital signals; 46 and 47 frame memories for storing temporarily the image signals converted into the digital signals in the A/D converting boards 44 and 45, respectively; and 48 a differential circuit for calculating the difference in brightness between the pixel elements of an image signal Fa stored into the frame memory 46 and an image signal Fb into the frame memory 47 to prepare a differential image signal (Fa−Fb). Reference numeral 49 represents a host computer in which the Q-switching control of the laser beam source 21 is made by the output of a control signal Qs to determine the emission timing of the laser beam and in synchronization with this, trigger signals are output to the TV camera and the frame memories 46 and 47 for detection and photography of the transmitted microscopic image and processing the image signal, and 50 demotes a data selector having a counter therein, for counting the control signal Qs output from the host computer 49 so that when the counted value is odd, a trigger signal Ta is output to the frame memory 46, while when it is even, a trigger signal Tb is output to the frame memory 47. The frame memories 46 and 47 are designed so that the output signals from the A/D converting boards 44 and 45 are stored into the memories, respectively, according to the input timing of the trigger signals Ta and Tb. Reference numeral 51 designates a polarizer driving circuit for outputting a polarizer driving signal Sr to the polarizer 33 in virtue of a control signal Pr output from the host computer 49, and 52 represents a CRT for displaying the differential image signal (Fa−Fb) analog-converted in the host computer 49.

Next, reference is made to the function of the above system.

First of all, adjustment is made of the amount of ultraviolet light with which the biological specimen 24 is irradiated. The control signal Pr is output to the polarizer driving circuit 51 from the host computer 49 and the polarizer driving signal Sr to the polarizer 33 from the polarizer driving circuit 51 to rotate the polarizer 33 to an adequate angle, and the amount of ultraviolet light is adjusted so that the transmitted microscopic image can be photographed with favorable contrast. After that, the control signal Qs is output form the host computer 49, the Q-switching control of the laser beam source 21 is made to output a laser pulse from the laser beam source 21, and X rays are produced from the target 22. At the same time, the trigger signals are delivered to the TV camera 41 and the frame memory 46, the transmitted microscopic image of carbon of the biological specimen 24 is photographed, and the digitized image signal is stored into the frame memory 46.

Next, the rotation angle of the polarizer 33 is controlled so that the biological specimen 24 now is not entirely subjected to the irradiation of the ultraviolet light. Similar to the foregoing, the control signal Qs is output from the host computer 49 to produce X rays from the target 22 and in synchronization with this, the trigger signals are supplied to the TV camera 41 and the frame memory 47, followed by photography of the transmitted microscopic image in terms of elements, excluding carbon, of the biological specimen 24 and storing of the digitized image signal into the frame memory 47.

Here, the transmitted microscopic image of the elements, excluding carbon, stored as the image signal Fb into the frame memory 47 is a background signal opposite to the transmitted microscopic image of carbon stored as the image signal Fa into the frame memory 46. Hence, if, in the differential circuit 48, calculations are preformed of the difference in brightness between the pixel elements of the image signal Fa stored into the frame memory 46 and the image signal Fb into the frame memory 47 so that the differential image signal (Fa−Fb) is prepared and taken into the host computer 49 for conversion into the analog image signal which is displayed on the next CRT 52, it is possible to observe the transmitted microscopic image of pure carbon only, which is free from the background attributable to absorption due to elements other than carbon, with good contrast.

Also, although the fourth embodiment is constructed so that, in view of the speed response of signal processing, the image signals are processed through a hardware differential circuit, it may well be such that the host computer directly reads out the image signals, which are processed by software.

Further, although each embodiment is designed so that the X-ray filter is disposed between the specimen and the X-ray objective lens, the disposition of the X-ray filter is not necessarily be limited to this position and it is only necessary to dispose it at the best position suitable for the design of the system, according to materials of optical elements to be used.

Finally, a description will be made of a specimen vessel applicable to the microscope system of the present invention. In the X-ray microscope system, it is an important subject that a soft X-ray microscopic image of the biological specimen is formed without exposing directly the specimen in a vacuum. Specifically, since soft X rays undergo considerable attenuation in air and cannot be transmitted over a long distance, there was the necessity of incorporating the entire system of the microscope in a vacuum vessel. As a result, the biological specimen had to be dried and could be observed only in vitro. Recently, an attempt is made to encapsulate the biological specimen in a pellet composed of a thin $Si_3N_4$ (silicon nitride) film developing mechanical strength to conserve the biological specimen in vivo even in a vacuum. With the wavelength band of $\lambda$=approximately 40 Å which arouses biologically interest, however, the transmittance of soft X rays regarding the thin $Si_3N_4$ film is so low that it has no appreciable practical use.

The specimen vessel mentioned above, which is suitable for the imaging system of the soft X-ray microscopic image including ultraviolet irradiation, has sufficient mechanical strength, can intercept a normal pressure space from a vacuum space, and provides complete transmittance in the wavelength band of $\lambda=65\sim43.7$ Å, in which at least an entrance window and an exit window are provided, the biological specimen to be observed is incorporated in the vessel, and the entrance and exit windows are each composed of a thin diamond film.

The specimen vessel for X-ray microscopes according to the present invention utilizes the property of the thin diamond film which has recently come to be fabricated, for example, by a CVD technique (chemical vapor deposition technique). Compared with thin films fabricated from silicon-based materials, such as Si, SiC, and $Si_3N_4$, the features of the thin diamond film are that it is homogeneous and withstands breaking stress. Further, in comparison with these thin silicon-based films, the thin diamond film has extremely high transmittance in the wavelength band of $\lambda$=43.7 Å or more. For the thin diamond film and the thin $Si_3N_4$ film, 1$\mu$ thick each, it is found that the transmittance of the thin diamond film is 56%, while that of the thin $Si_3N_4$ film amounts to no more than 0.1%, when the transmittance of soft X rays having $\lambda=44.7$ Å is calculated from the equation:

$$T=\exp[-4\pi\kappa/\lambda]$$

where T is the transmittance, $\kappa$ is the imaginary part of the complex index of refraction, and $\lambda$ is the wavelength of a soft X ray.

From the fact that a band gap Eg of the diamond is 5.5 eV [about 200 nm (2000 Å) in terms of a wavelength], when protein is irradiated with ultraviolet light of $\lambda=300\sim250$ nm (3000∼2500 Å) to photograph the soft X-ray microscopic image in amino acids, such as phenylalanine, tryptophan, and tyrosine, the excitation of the thin diamond film does not occur because the wavelength of the ultraviolet light is longer than that corresponding to the band gap Eg of the diamond, with the result that the ultraviolet light of $\lambda=300\sim250$ nm (3000∼2500 Å) is favorably transmitted through the thin diamond film.

Thus, for the soft X-ray microscope for forming the soft X-ray microscopic image of the biological specimen by means of soft X rays with the wavelength of $\lambda=65\sim43.7$ Å, including the ultraviolet irradiation, the use of the thin diamond film makes it possible to provide an idealized biological specimen vessel in which its mechanical strength is sufficient and the transmittance of soft X rays is also high.

Fifth embodiment

Figure 14:
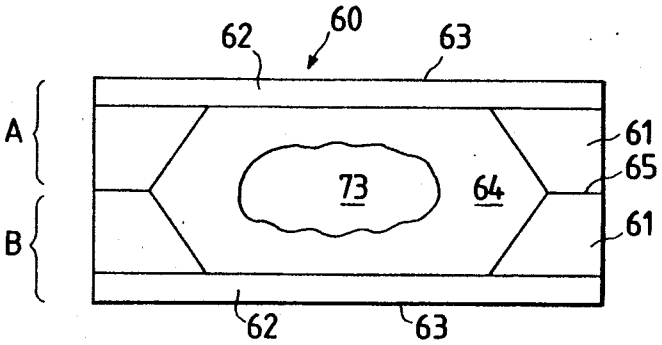
FIG. 14 is a sectional view showing a specimen vessel which is a fifth embodiment.

FIG. 14 shows a sectional view of a specimen vessel for soft X-ray microscopes which is the fifth embodiment of the present invention. A specimen vessel 60 of this embodiment is constructed from two sets of structures A and B configured symmetrically by providing thin diamond films 62 on supporting substrates 61 whose materials are Si (silicon), in which the portions of the thin diamond films 62 function as an entrance window 63 and an exit window 63 and are shaped into a capsule form as a whole.

The method of fabricating the specimen vessel is outlined as follows: The structures A and B are made in such a way that Si wafers are coated with the thin diamond films through the CVD technique and then an anisotropic etching process is applied to remove Si only. The two sets of structures A and B thus constructed, after a biological specimen 73 is contained therein, along with a physiological saline solution 64, are bonded with an Si-based adhesive at a contact surface 65. It is only necessary to dispose the specimen vessel 60 of the capsule form at the position of an object point in the vacuum chamber of the soft X-ray microscope.

Next, reference is made of the arrangement of the X-ray microscope using the specimen vessel. The X-ray microscope is designed to have a biological specimen incorporated in a specimen vessel, a light source for emitting ultraviolet light liberating the outermost cell electrons of a carbon atom contained in the specimen from the carbon atom, a radiation source for emitting X rays containing a wavelength of 65~43.7 Å, an objective lens for converging the X rays transmitted through the specimen, and a detector for sensing the X rays converged by the objective lens, in which the specimen is irradiated with the ultraviolet light and the X rays at once to secure a specimen image, and an entrance window of the specimen vessel on which the ultraviolet light and the X rays are incident and an exit window of the specimen vessel from which the X rays emerge are made of thin diamond films.

Sixth embodiment

Figure 15:
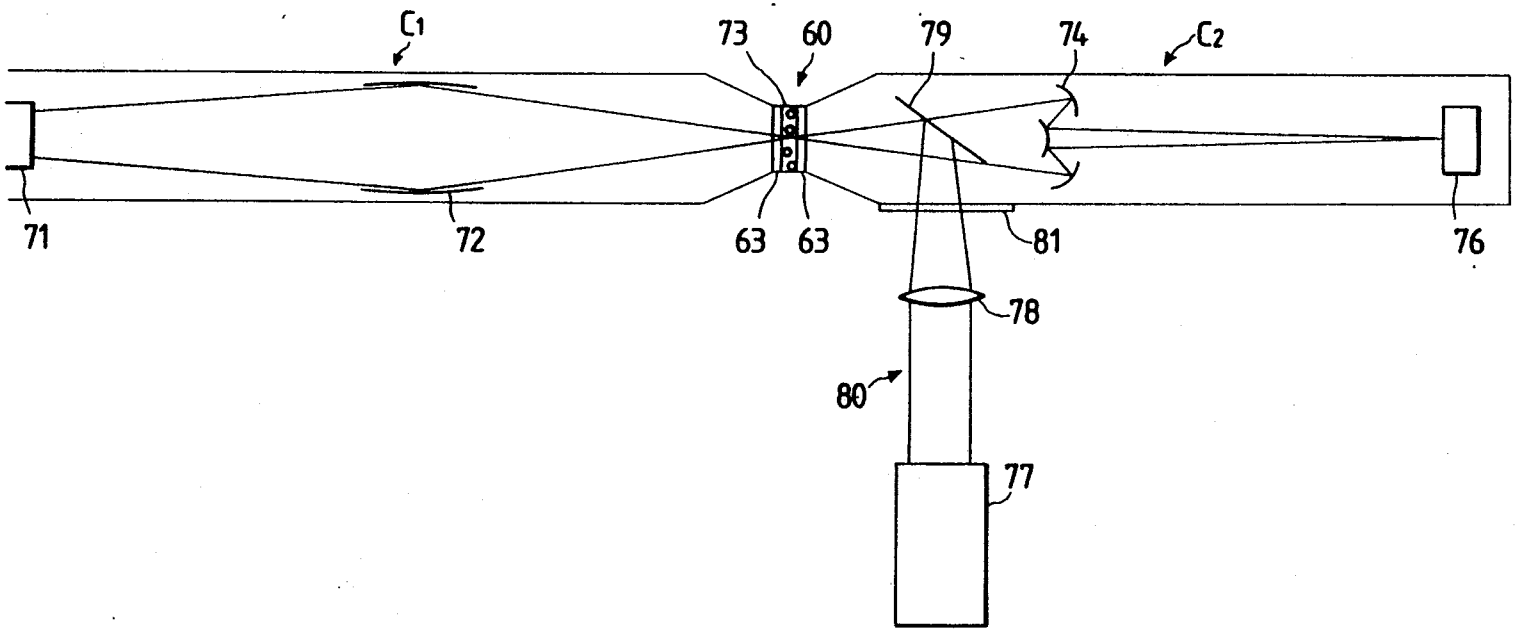
FIG. 15 is a view showing the arrangement of a sixth embodiment.

FIG. 15 shows the sixth embodiment of the present invention, with the arrangement of the soft X-ray microscope using the specimen vessel. The soft X-ray microscope is equipped with two chambers of a chamber C1 disposed on the condenser side and a chamber C2 on the objective side, each of which is in a vacuum state, sandwiching the specimen vessel 60 therebetween. The chamber C1 on the condenser side houses an X-ray radiation source 71 and a condenser lens (totally reflecting mirror type) 72, while the chamber C2 on the objective side a Schwarzschild objective lens 74, a detector (CCD) 76, and an X-ray filter 79 also used as a mirror for ultraviolet irradiation (thin Be film). The condenser lens (totally reflecting mirror type) 72 utilizes total reflection like the Wolter type mirror. Further, an ultraviolet optical system 80 is disposed which is provided with a radiation beam perpendicular to that of the chamber C2 on the objective side and includes an ultraviolet light source 77 for outputting an ultraviolet laser beam and a condenser lens 78. On the side face of the chamber C2 is disposed an ultraviolet entrance window 81 opposite to the mirror 79. The specimen vessel 60 is exaggerated in the figure, compared with other components.

The specimen vessel 60 situated between the chambers C1 and C2 is constructed as follows: The end portions at which the chambers C1 and C2 are opposite to each other correspond to the optical windows 63 formed of the thin diamond films and the chambers C1 and C2 are each held in a vacuum state. These two optical windows 63 provide an extremely narrow space of a few $\mu$ between the thin diamond films, and the wet biological specimen 73 is enclosed in the space, with an additional hermetical measure, if necessary. For the purpose of replacing the biological specimen 73 with another, the mechanism, although not shown, is provided such that the relative positions of the chambers C1 and C2 can be adjusted. Hence, the X-ray microscope of the present invention has the advantage that the replacement of the biological specimen 73 is possible in the atmosphere, without opening the chambers C1 and C2 in vacuum states.

In the sixth embodiment shown in FIG. 15, the ultraviolet laser beam emitted from the ultraviolet light source 77 traverses the condenser lens 78 and, through the mirror 79, is transmitted by the optical window 63 which is the entrance window of the specimen vessel 60, at the end portion of the chamber C2, to irradiate the biological specimen 73. Consequently, only the carbon atom of particular protein contained in the biological specimen 73 is ionized by the ultraviolet laser beam. On the other hand, X rays emitted as a probe from the X-ray radiation source 71 pass through the condenser lens (totally reflecting mirror type) 72 and are transmitted through the optical window 63 which is the entrance window of the specimen vessel 60, at the end portion of the chamber C1, to irradiate the biological specimen 73. Subsequently, the X rays leave the optical window 63 of the chamber C2 as the exit window of the specimen vessel 60 and, through the X-ray filter 79 and the Schwarzschild objective lens 74, reach the detector (CCD) 76. The transmitted microscopic image of the biological specimen 73 can thus be observed as the image of high quality through the detector (CCD) 76.

What is claimed is:

1. An X-ray microscope in which a specimen is irradiated with X rays emitted from an X-ray radiation source and the X rays transmitted through the specimen are received by an X-ray detector to secure an image of an object, wherein an X-ray filter for transmitting radiation having a wavelength between 43.7 and 65 Å and a light source for emitting ultraviolet light having a wavelength of at least 100 nm are disposed in an optical path from said X-ray radiation source to said X-ray detector, the ultraviolet light from said light source being reflected from said X-ray filter to irradiate said specimen.

2. An X-ray microscope according to claim 1, comprising means for changing an intensity of the ultraviolet light with which said specimen is irradiated.

3. An X-ray microscope according to claim 2, further comprising means for forming a differential signal by extracting a difference between a first image signal derived from said X-ray detector by irradiating said specimen with the ultraviolet light of the wavelength of at least 100 nm and the X rays of the wavelengths of 43.7 to 65 Å and a second image signal derived from said X-ray detector by irradiating said specimen with only the X rays of the wavelengths of 43.7 to 65 Å.

4. An X-ray microscope according to claim 1 or 2, further comprising a condenser disposed between said X-ray radiation source and said specimen, for condensing the X rays onto said specimen, and an objective optical system disposed between said specimen and said X-ray detector, for focusing the X ray from said specimen.

5. An X-ray microscope according to claim 4, wherein said objective optical system is a reflecting optical system comprising reflecting mirrors, each coated with a multilayer film formed of materials containing carbon.

6. An X-ray microscope according to claim 5, wherein said objective optical system is a Schwarzschild optical system.

7. An X-ray image forming apparatus comprising:

an X-ray radiation source in which a target is irradiated with a beam from a laser beam source to produce a plasma, for emitting X rays having wavelengths of 43.7 to 65 Å from the plasma;

a condenser for irradiating a specimen with the X rays;

an objective optical system for focusing the X rays transmitted through said specimen;

an X-ray detector for detecting the X rays passing through said objective optical system;

a filter disposed obliquely between said X-ray radiation source and said X-ray detector, for transmitting radiation having wavelengths of 43.7 to 65 Å and reflecting radiation having a wavelength of at least 100 nm;

beam splitting means for splitting a part of the beam from said laser beam source; and a frequency converting optical element for receiving a laser beam split by said beam splitting means to emit ultraviolet light having a wavelength of at least 100 nm, said ultraviolet light being reflected from said filter to irradiate said specimen.

8. An X-ray image forming apparatus according to claim 7, wherein said frequency converting optical element has a property of changing an intensity of the ultraviolet light emerging according to a change in a polarizing state of the laser beam of incidence, and a polarizing element is disposed between said laser beam source and said frequency converting optical element.

9. An X-ray image forming apparatus according to claim 8, further comprising means for forming a differential signal by extracting a difference between a first image signal derived from said X-ray detector by irradiating said specimen with the ultraviolet light of the wavelength of at least 100 nm and the X rays of the wavelengths of 43.7 to 65 Å and a second image signal derived from said X-ray detector by irradiating said specimen with only the X rays of the wavelengths of 43.7 to 65 Å.

10. A specimen vessel for X-ray microscopes having at least an entrance window and an exit window, constructed so that a biological specimen to be observed is incorporated therein, wherein said entrance window and said exit window are formed of thin diamond films.

11. An X-ray microscope comprising:

a biological specimen incorporated in a specimen vessel;

a light source for emitting ultraviolet light liberating outermost cell electrons of a carbon atom contained in said specimen from the carbon atom;

a radiation source for emitting X rays containing wavelengths of 65 to 43.7 Å;

an objective lens for converging the X rays transmitted through said specimen; and a detector for sensing the X rays converged by said objective lens, said specimen being irradiated with the ultraviolet light and the X rays simultaneously to secure an image of said specimen, wherein an entrance window of said specimen vessel on which the ultraviolet light and the X rays are incident and an exit window of said specimen vessel from which the X rays emerge are formed of thin diamond films.

* * * * *